US006952904B2

(12) United States Patent
Nickel

(10) Patent No.: US 6,952,904 B2
(45) Date of Patent: Oct. 11, 2005

(54) MOUNTING SYSTEM

(75) Inventor: Shane L. Nickel, Fargo, ND (US)

(73) Assignee: Reechcraft, Inc., Fargo, ND (US)

( * ) Notice: Subject to any disclaimer, the term of this patent is extended or adjusted under 35 U.S.C. 154(b) by 180 days.

(21) Appl. No.: 10/194,987

(22) Filed: Jul. 11, 2002

(65) Prior Publication Data

US 2003/0029121 A1 Feb. 13, 2003

Related U.S. Application Data

(60) Provisional application No. 60/305,306, filed on Jul. 13, 2001.

(51) Int. Cl.[7] ..... E04C 5/00; E04B 9/00

(52) U.S. Cl. ..... 52/698; 52/454; 52/255; 52/498.2; 52/745.21

(58) Field of Search ..... 52/386, 388, 431–432, 52/454, 489.2, 674–676, 698, 712–715, 745.21, 262, 255; 248/222.14, 254, 261–262, 265–266; 411/466

(56) References Cited

U.S. PATENT DOCUMENTS

| | | | | | |
|---|---|---|---|---|---|
| 1,242,609 | A | * | 10/1917 | Schumacher | 52/357 |
| 1,966,167 | A | * | 7/1934 | Denk | 52/698 |
| 2,208,094 | A | * | 7/1940 | Crandell | 52/346 |
| 2,260,615 | A | * | 10/1941 | Gibbs et al. | 52/713 |
| 2,296,416 | A | * | 9/1942 | Balduf | 52/241 |
| 3,260,021 | A | * | 7/1966 | Katz | 52/27 |
| 4,078,352 | A | | 3/1978 | Knowles | |
| 4,359,849 | A | * | 11/1982 | Goeman | 52/479 |
| 4,361,997 | A | | 12/1982 | DeCaro | |
| 4,480,416 | A | * | 11/1984 | Judkins et al. | 52/376 |
| 4,523,531 | A | * | 6/1985 | Bishara | 110/336 |
| 4,948,079 | A | * | 8/1990 | Baeta | 248/309.1 |
| 5,116,179 | A | * | 5/1992 | Matlock | 411/466 |
| 5,152,117 | A | | 10/1992 | Wynar | |
| 5,249,400 | A | * | 10/1993 | Turner | 52/364 |
| 5,392,908 | A | | 2/1995 | Black, Jr. | |
| 5,546,723 | A | * | 8/1996 | Jones | 52/698 |
| 5,620,768 | A | * | 4/1997 | Hoffmann, Sr. | 428/77 |
| 5,642,597 | A | | 7/1997 | Hendrickson | |
| 5,685,116 | A | * | 11/1997 | Bradshaw et al. | 52/311.1 |
| 5,720,568 | A | | 2/1998 | Kairi | |
| 5,983,589 | A | | 11/1999 | Daudet | |
| 6,047,504 | A | | 4/2000 | Dusenberry | |
| 6,196,506 | B1 | | 3/2001 | Wakai | |
| 6,607,621 | B1 | * | 8/2003 | Swanson | 156/94 |

* cited by examiner

*Primary Examiner*—Winnie Yip
(74) *Attorney, Agent, or Firm*—Merchant & Gould P.C.

(57) ABSTRACT

A wall mounting system includes an interlocking mesh backing element mounting to a substrate, such as foam insulation. The backing element has pointed corner portions that are pushed into the substrate and retain the backing element. A wall covering layer such as drywall overlays the substrate and the mesh backing element. A fixture having has bolts, screws or other attachment members extending through the wall covering layer and the mesh backing element. The system has several backing element styles, including planar elements, inner right angle elements and outer right angle elements.

16 Claims, 11 Drawing Sheets

MOUNTING SYSTEM

This application hereby claims benefit of priority under Title 35, United States Code § 119(e) of U.S. provisional application Ser. No. 60/305,306 filed Jul. 13, 2001 and is incorporated herein by reference.

BACKGROUND OF THE INVENTION

1. Field of the Invention

The present invention relates to a mounting system for building walls, and in particular to a mounting system utilizing interlocking mesh backing elements.

2. Description of the Prior Art

Mounting fixtures and other elements to walls is a common job with which many problems may be encountered. Many wall coverings, such as sheetrock, drywall, plasterboard, paneling and other similar types of wall covering materials, do not provide a secure base to securely attach fixtures. In addition, such materials often have insulation backing the sheetrock or similar material where the fixture is to be mounted. Insulation is typically a fiberglass or foam insulation that does not provide a sufficient anchor point for receiving screws, bolts and other fasteners. Studs for the frame may provide a better solution for mounting, but may be difficult to locate behind an outer wall covering. In addition, it is often desired to mount a picture or other fixture at a location wherein a stud is not available.

To overcome such problems, mounting hardware has been developed that provides fasteners that expand radially when a screw is inserted to grip the back of the wall covering panel. Such a system is adequate in many mounting situations, but further improvements are possible. These mounting methods are limited to the particular type of screw and do not provide for nails or different sizes as may be needed for some mounting applications. Moreover, the load capacity needed for some mounting applications is greater than that provided with such prior art devices. Where handrails and other fixtures with high load requirements are mounted, prior art devices do not provide sufficient load capacity or meet the code needed for mounting through the outer wall layer, such as sheetrock. The prior mounts have low load capacities, as the load is concentrated at very small areas where the screws or other mounting hardware attach. When too great a load is placed on the mounting hardware, the hardware may pull out and the fixture detached from the wall.

It can be seen then that a new and improved wall mounting system is needed. Such a system should provide for simple, economical and secure mounting through the outer wall layer. The system should be easy to install without requiring special tools or modification to the insulation, wall or other building materials. Moreover, such a system should provide for high load capacity without having to utilize mounting at locations wherein only studs are available. The present invention addresses these as well as other problems associated with wall mounting systems.

SUMMARY OF THE INVENTION

The present invention is directed to a mounting system, and in particular to a system for mounting fixtures to walls utilizing mesh backing elements.

The mounting system of the present invention is typically utilized with walls having an inner frame with vertical stud members and a substrate, such as a rigid foam insulation placed between the studs. The studs and insulation are typically covered with a material such as paneling or drywall panels and then painted, wallpapered, etc. The mounting system has mesh backing elements that include pointed tab portions at the corners of the backing elements that are pressed into and engage the substrate. Fixtures may be mounted to the wall covering, and in some instances, the wall covering may be directly mounted to the backing elements. Mounting hardware, such as screws or bolts, are mounted through the mesh elements so that the threads of the mounting hardware engage the strands of the mesh. The mesh is usually slightly deformed while accommodating the hardware and engaging the threads. The mesh has a diamond pattern in a preferred embodiment that provides minimal deformation while accommodating the typical hardware utilized for such applications.

The mesh backing elements provide an enlarged effective mounting area as the bolts, screws or other hardware attaches to the backing element and the load is spread over the area of the backing element, rather than just being directed at the point where the bolt or screw passes through the drywall and insulation.

The engagement portions of the backing elements may simply be corner portions bent substantially perpendicular to the plane of the element that are pointed to be pushed into the substrate. The engagement tabs are spaced apart so that the load on the substrate is dispersed over a larger area.

In addition to planar backing elements, the mounting system of the present invention also utilizes right angle corner elements. A first embodiment of a corner element includes tabs extending outward from each side of the right angle portion. Such a backing element is configured for mounting to interior corners. A second embodiment of a corner backing element includes tab portions extending inwardly from the right angle portion. The second embodiment of the corner portion is configured for exterior corners of walls.

The backing elements may be configured in a variety of sizes for different applications and load requirements. In addition, various combinations of backing elements may be utilized to accommodate the specific mounting requirements for each application and to provide for increased mounting capacity by dispersing load over two or more backing elements, rather than just a single element.

These features of novelty and various other advantages, which characterize the invention, are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENTS

Figure 1:
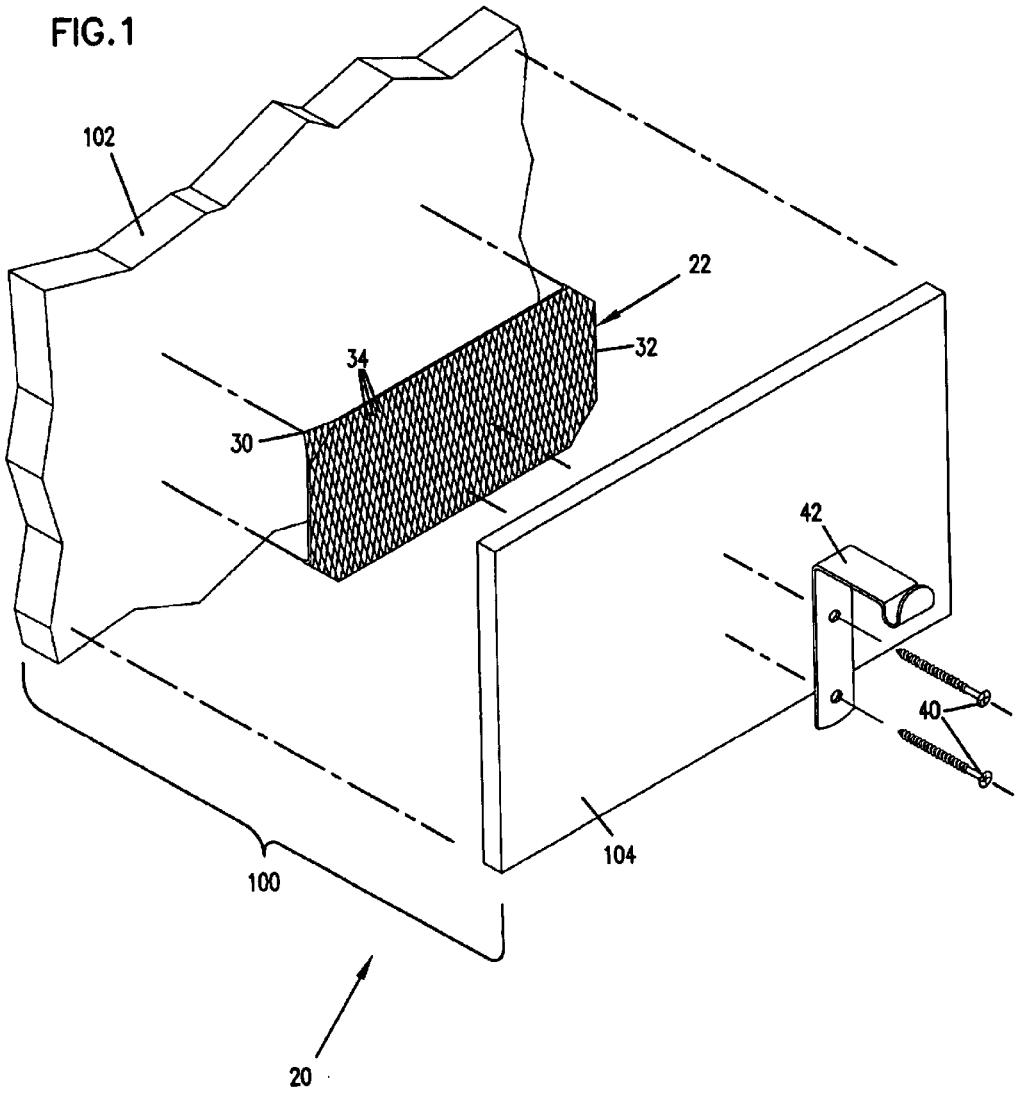
FIG. 1 shows an exploded perspective view of a mounting system according to the principles of the present invention showing a first mounting application.

Referring now to the drawings, and in particular FIG. 1, there is shown a mounting system according to the present invention, generally designated 20. The mounting system 20 is utilized with a building wall 100, which typically has an inner frame (not shown) including vertical wall studs. However, as it is often impractical or impossible to mount directly over a stud, mounting may have to occur over a wall substrate 102, such as rigid foam insulation. Such walls 100, are typically finished with a wall covering 104, such as drywall or other well known wall surface material that mount over the insulation and is affixed to the wall studs. As the substrate 102 and wall covering 104 typically do not have sufficient load capacities to support fixtures 42 mounted using typical mounting hardware 40, such as bolts or screws inserted through the drywall 104 and into the foam insulation 102, the hardware routinely pulls out through the layers and failing to support the fixture 42.

According to the present invention, a mesh backing element 22 is inserted intermediate the substrate 102 in the wall covering 104, as shown in FIGS. 1–2 and 6–11. The backing element 22 is formed of an interlocking mesh forming a multiplicity of openings 34. The backing element includes a planar portion 32 and pointed tab portions 30 positioned at the corners of the planar portion 32. The pointed tab portions 30 are pressed into the substrate 102 to retain the backing element 22 against the substrate 102. The outer wall covering 104 is placed over the substrate 102 and the backing element 22 and mounted in a normal manner. However, the fixture 42 is mounted with the hardware 40 mounting through the wall covering 104 and the backing element 22. The large area of the backing element spreads the load capacity over a wider portion of the wall covering 104 rather than at a single point, thereby increasing the load capacity. The hardware 40 screws or bolts into the mesh through the openings 34. The threads of the hardware 40 engage the strands of the mesh so that a secure attachment is made between the hardware 40 and the backing element 22.

Figure 2:
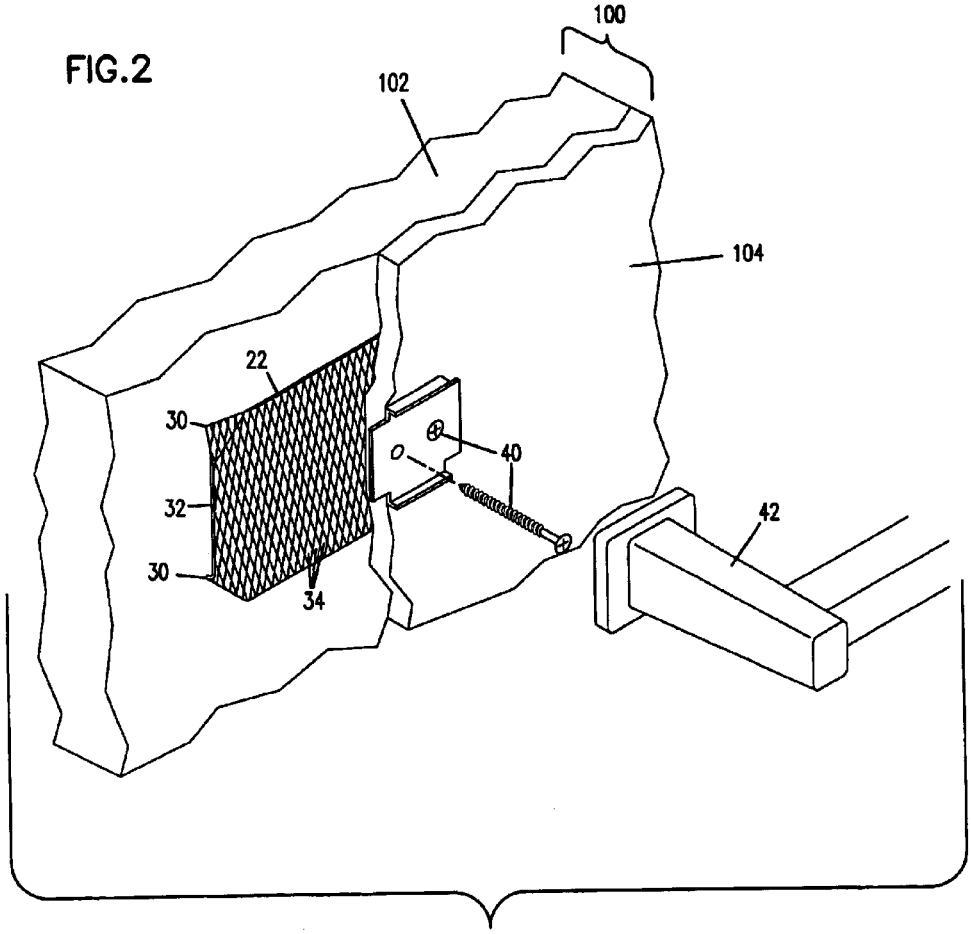
FIG. 2 shows a perspective view with portions broken away, of the mounting system shown in FIG. 1 showing a second mounting application.
Figure 3:
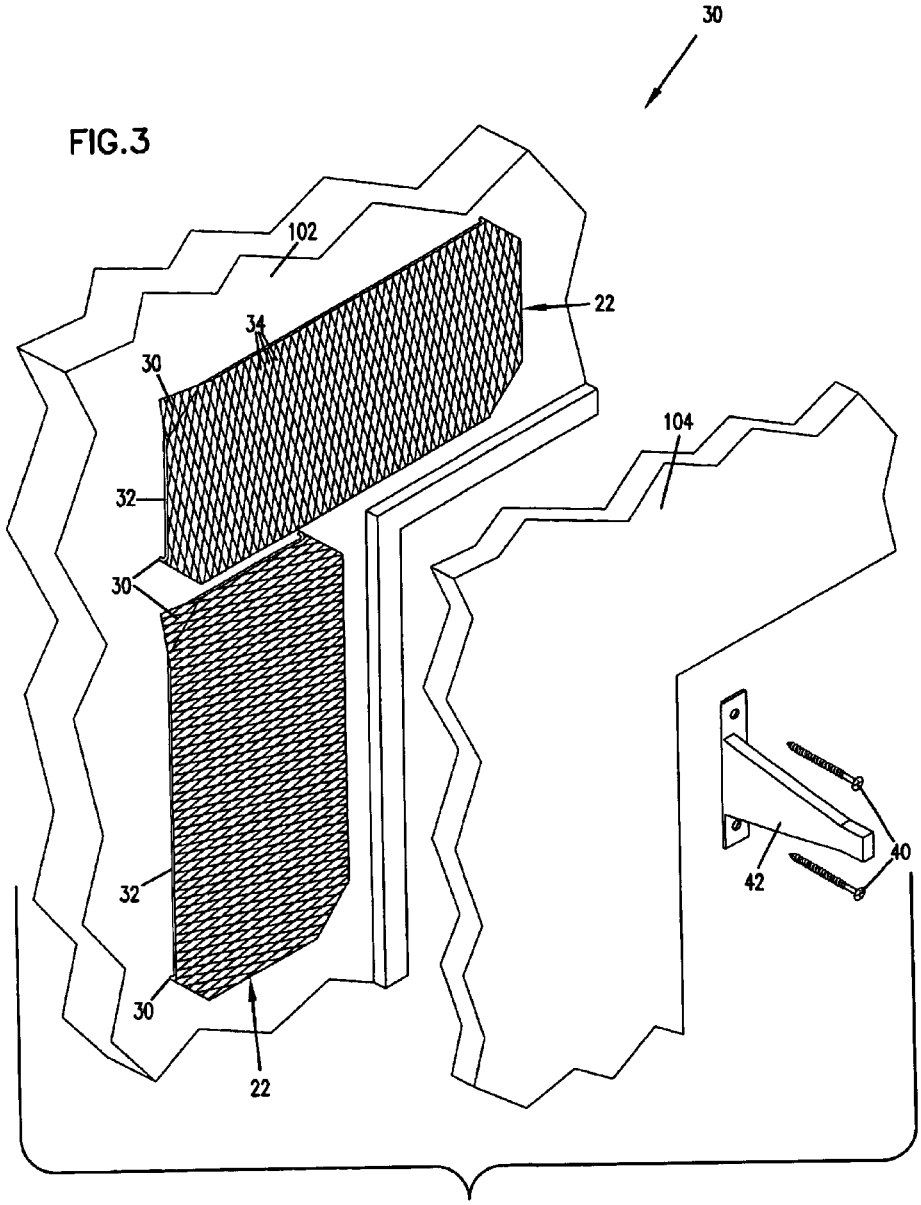
FIG. 3 shows a perspective view of two backing elements shown in FIG. 1 combined for a mounting application.

As shown in FIG. 2, when mounted, the backing element 22 is hidden from view and the fixture 42 has a clean, finished appearance. Moreover, the effective mounting area of the backing element 22 is substantially enlarged and stresses are reduced. This arrangement increases the capacity so that fixtures requiring greater load capacity, such as hand railings, frames, cabinets and other heavy elements, have a greater effective area upon which the fixture 42 is supported. It will be appreciated that greater support capacity can be achieved by increasing the size of the backing elements 22 utilized. In addition, as shown in FIG. 3, multiple backing elements 22 may be utilized to support fixtures 42. The elements 22 may be placed side by side and adjacent one another around a corner to provide an L-shaped mounting element receiving one or more hardware elements 40 in each backing element 22 to provide a greater effective mounting and support area.

Figure 4:
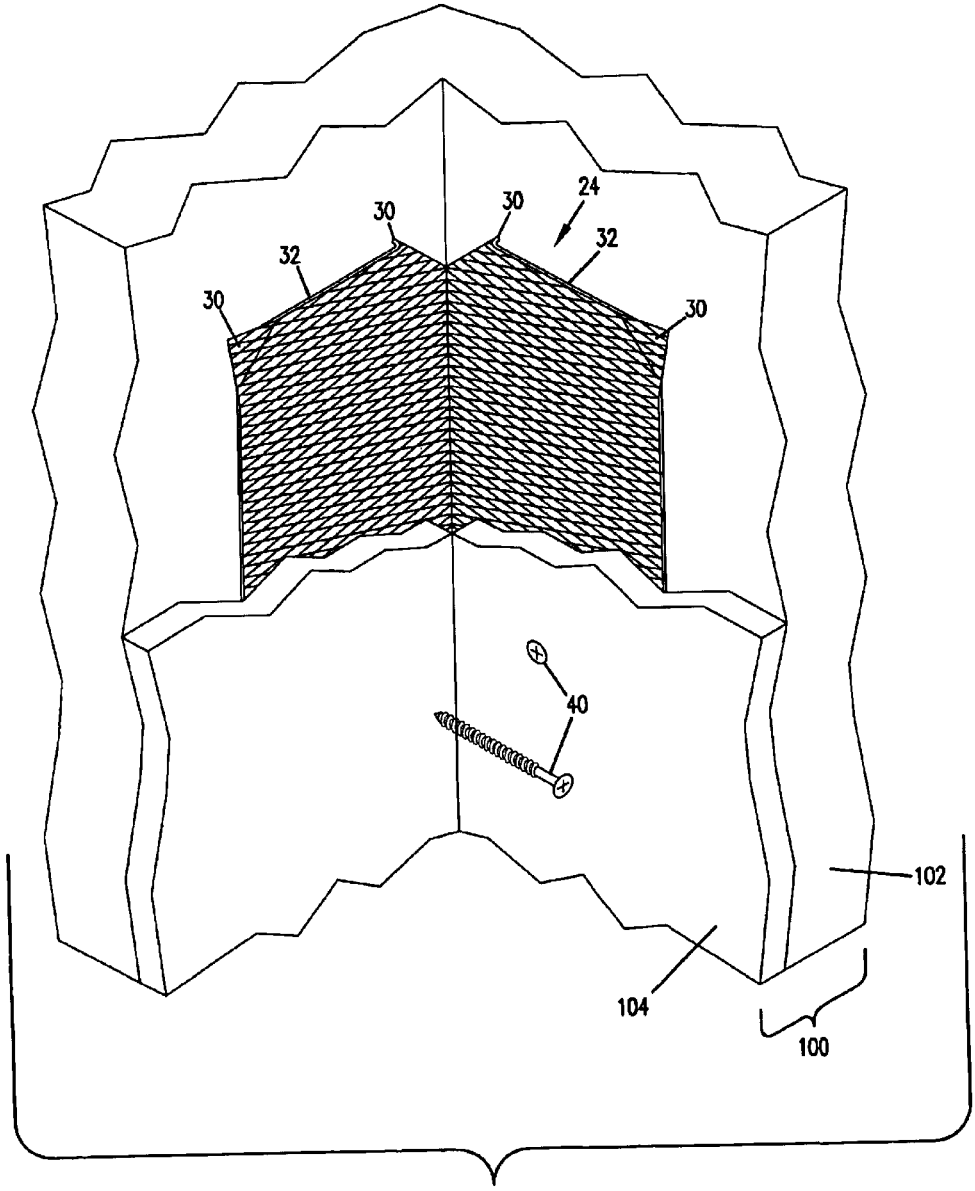
FIG. 4 shows a perspective view of a second embodiment of a backing element for the mounting system shown in FIG. 1 in an interior corner mounting application.

Referring to FIG. 4, there is shown a second embodiment of a mesh backing element 24. The backing element 24 includes planar portions 32 at a right angle to one another forming a corner. Pointed tab portions 30 extend outward from the L-shaped profile for mounting to interior corners of buildings. Such a configuration provides support to difficult to access locations at the peak of the corner and also provides support along the intersection between the two converging sections of wall 100. Greater support is provided, as well as improved, clean appearance.

Figure 5:
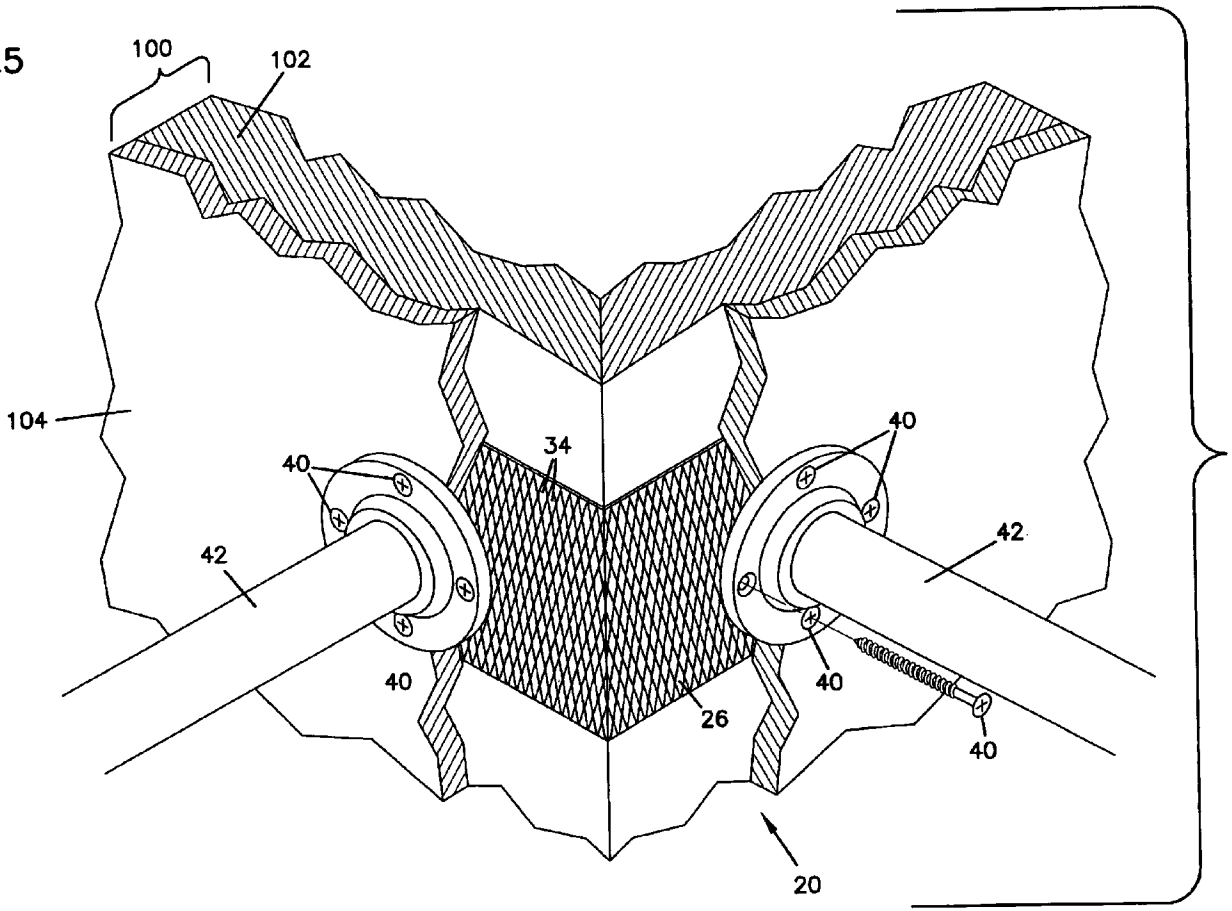
FIG. 5 shows a perspective view of a third embodiment of a mounting element for the mounting system shown in FIG. 1 in an exterior corner mounting application.
Figure 6:
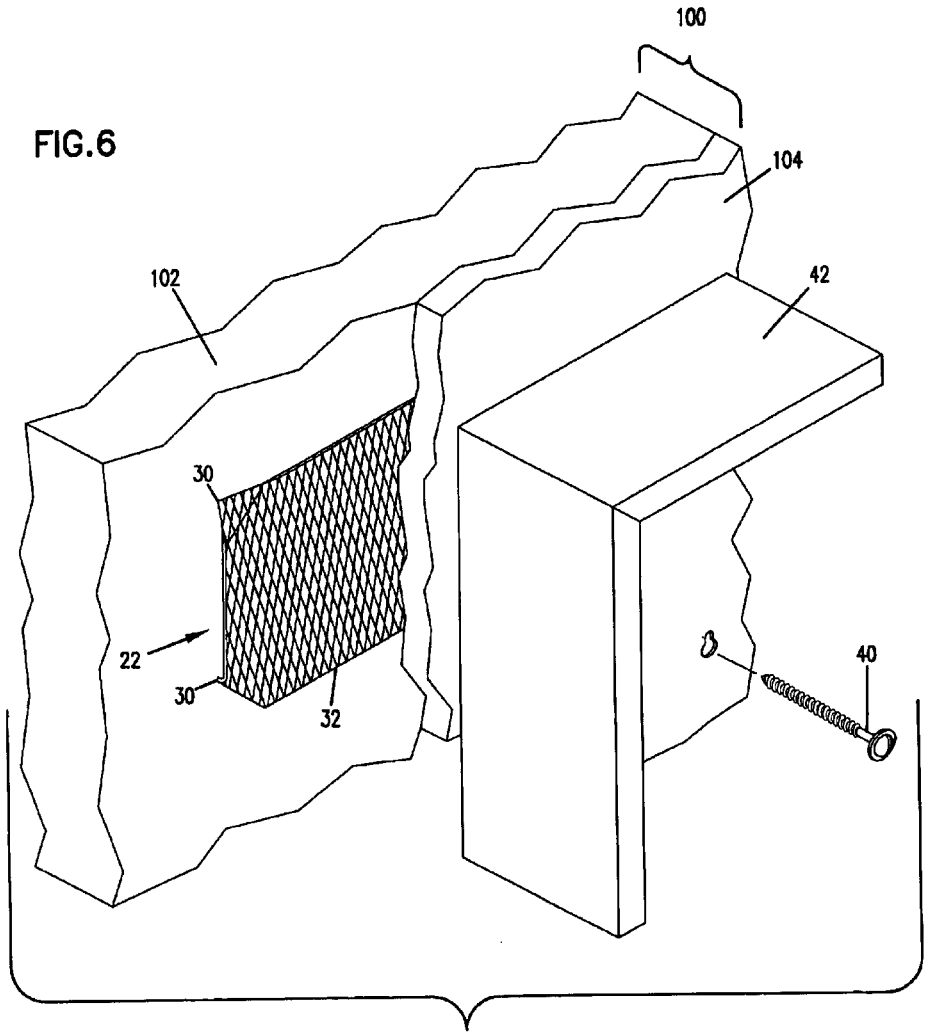
FIGS. 6–11 show perspective views with portions broken away, of the mounting system shown in FIG. 1, in other mounting applications.
Figure 7:
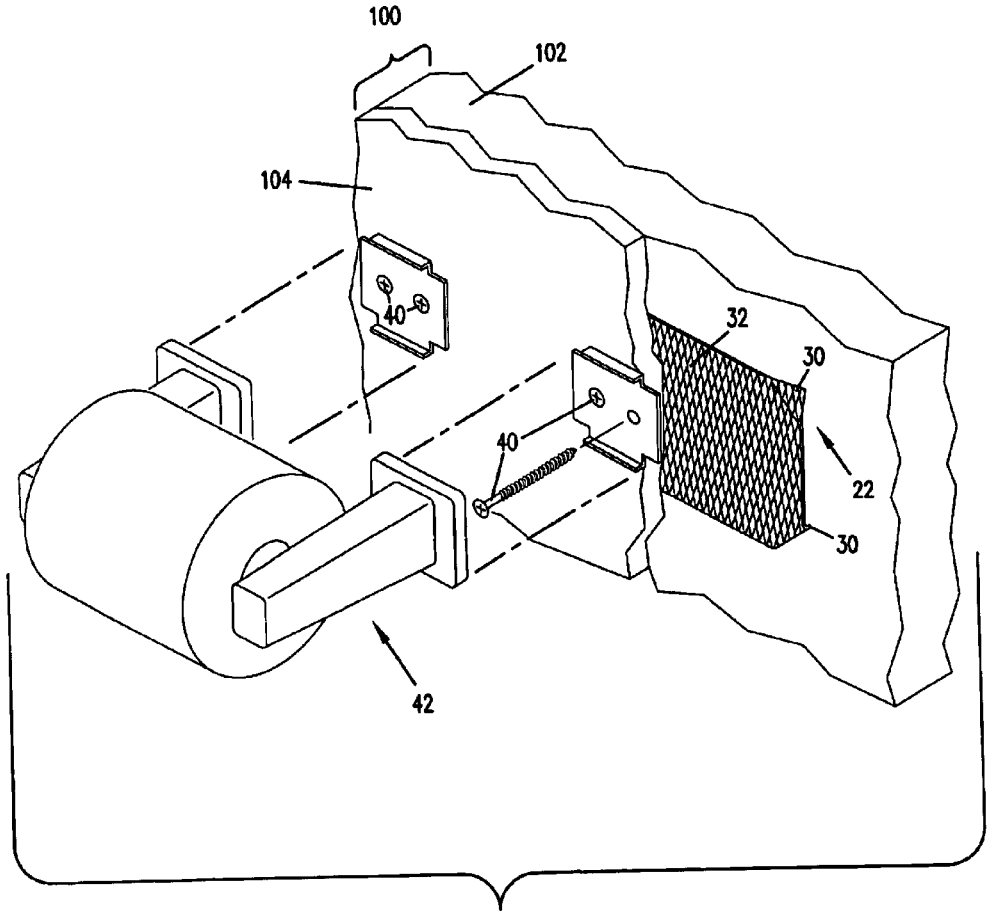
Figure 8:
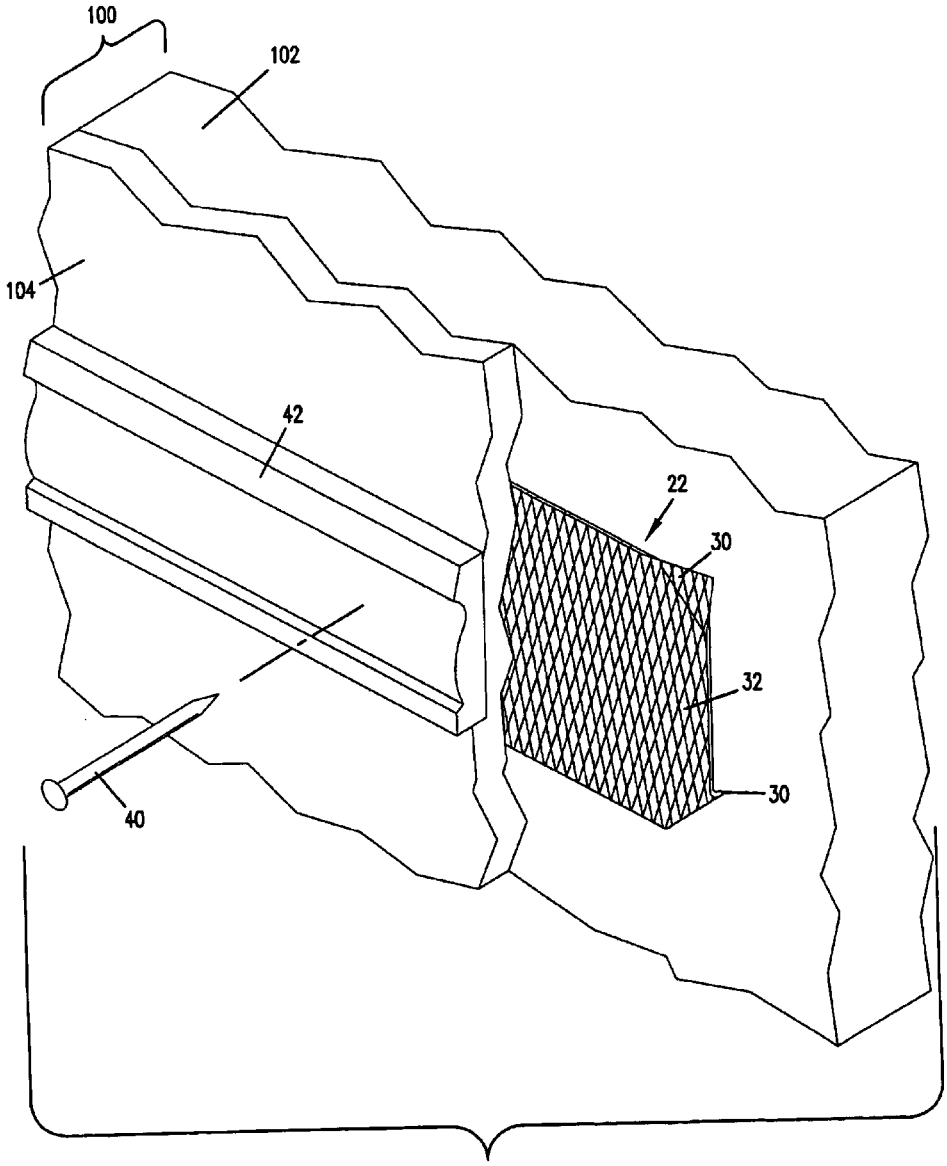
Figure 9:
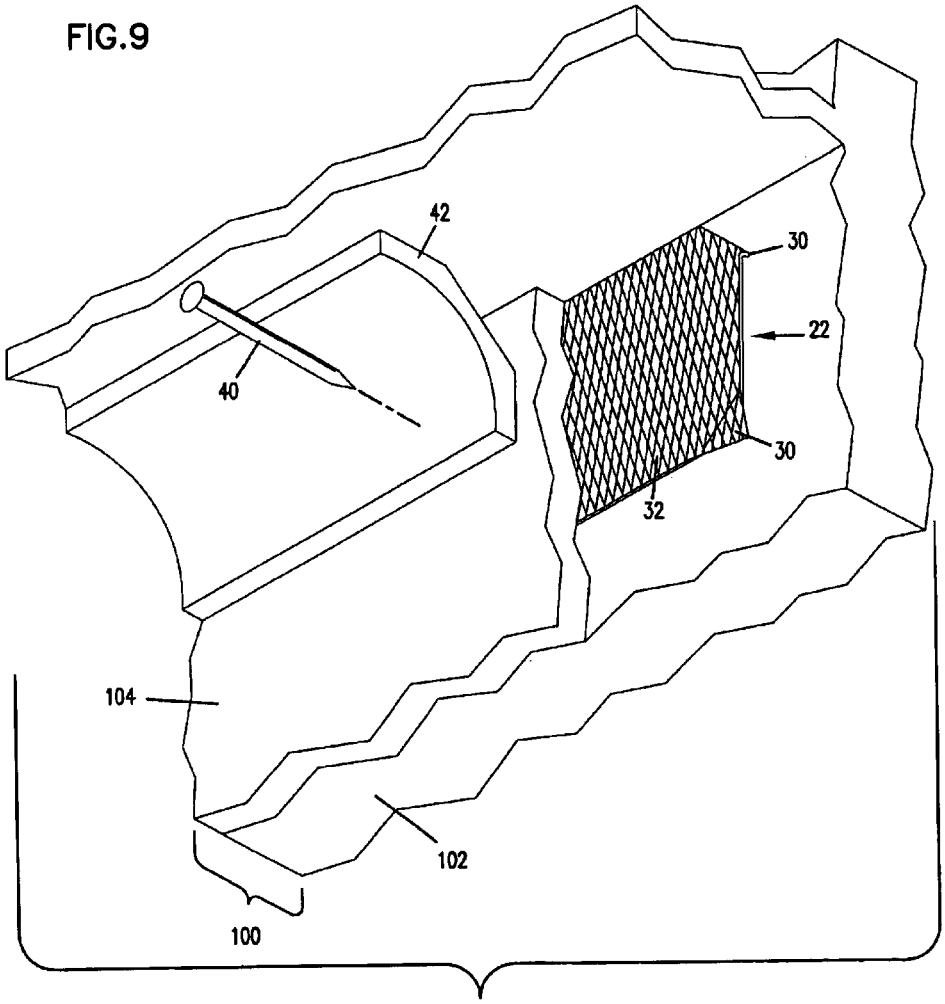
Figure 10:
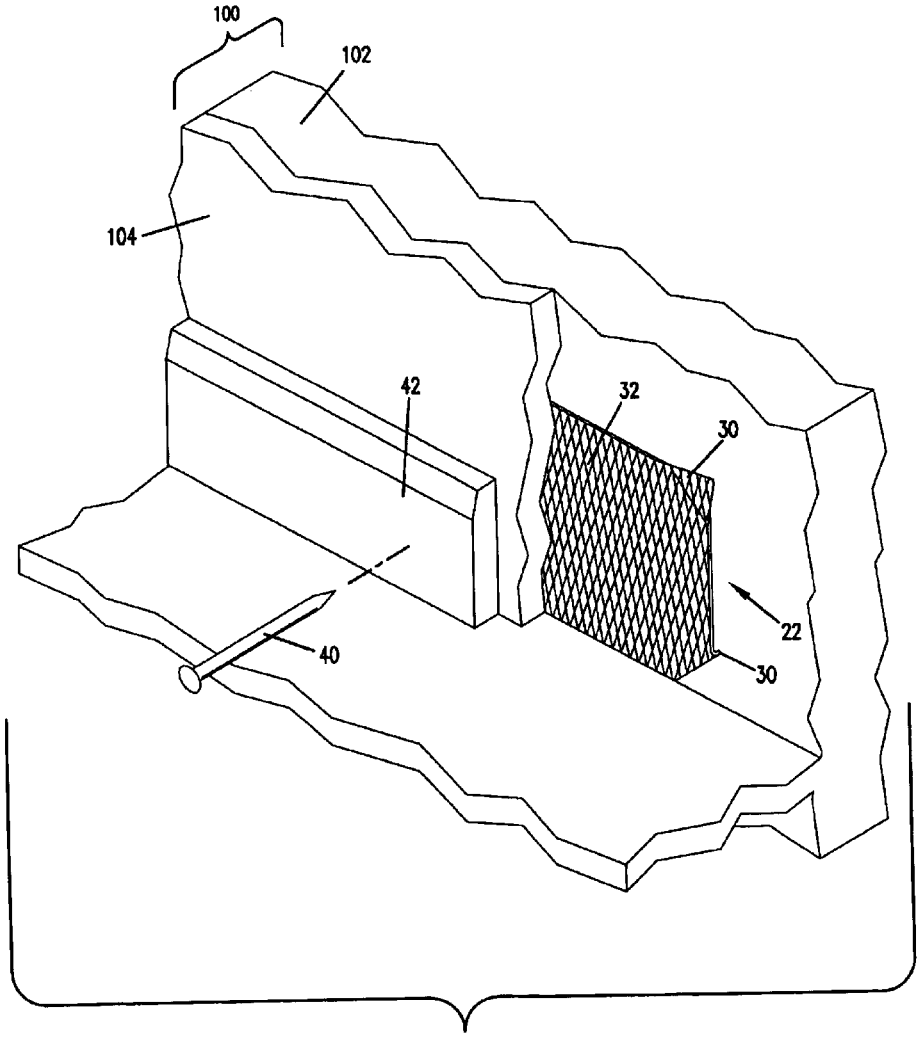
Figure 11:
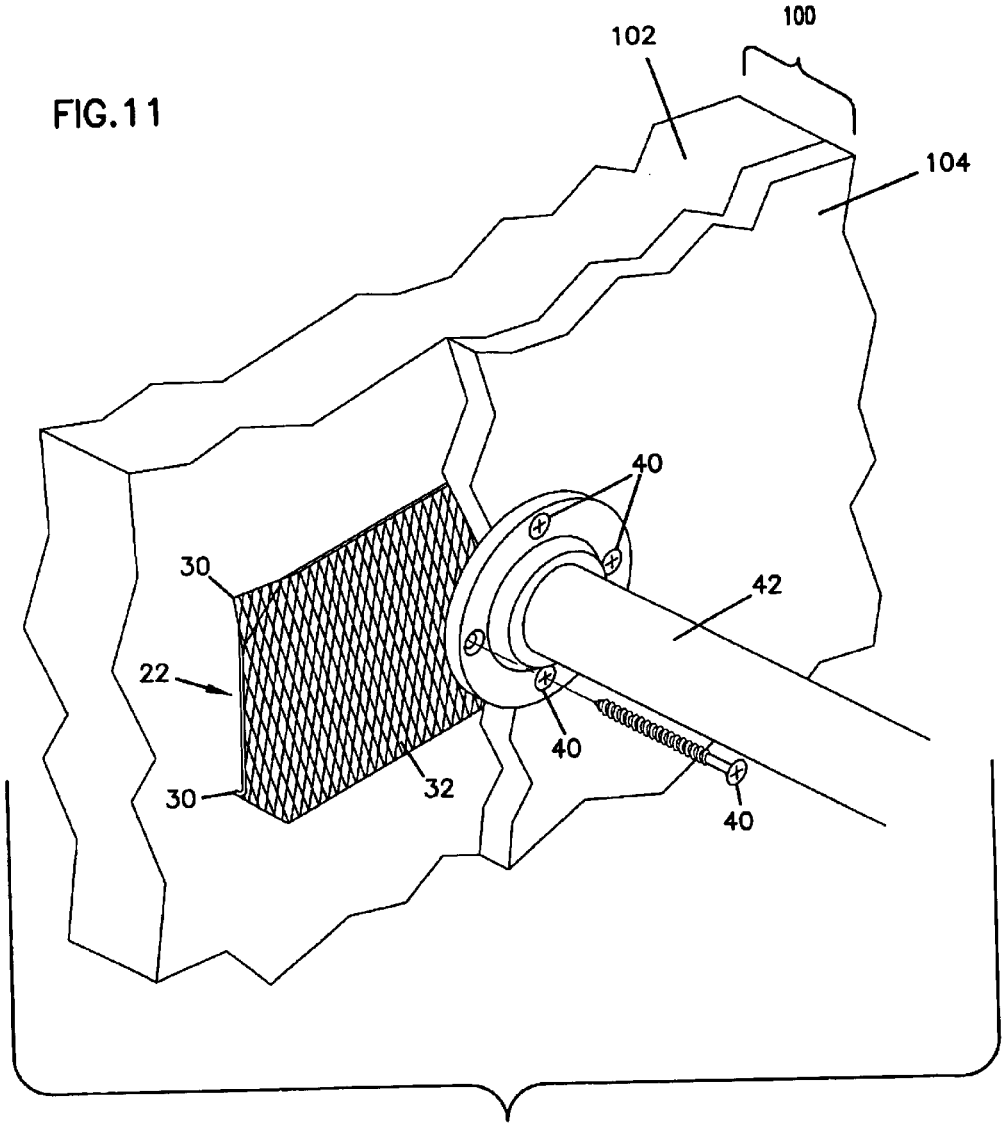

Referring now to FIG. 5, there is shown a third embodiment of a mesh backing element, generally designated 26. The backing element 26 has a profile similar to backing element 24, but the pointed tabs 30 extend inward from the right angle of planar portions 32 so that the backing element 26 is mountable to exterior corners. The corner backing element 26 aids in bringing the two converging sections of the wall 100 together and retaining them in alignment and in engagement. It will be appreciated that multiple mounting elements may be utilized in a spaced apart arrangement to retain the underlying substrate 102 and provide a clean, finished corner and receiving the outer layer 104.

In one embodiment, the mesh backing elements 22, 24 and 26 having a diamond shaped mesh pattern. A typical preferred application utilizes a mesh of 18 gauge cold rolled steel in a ⅛ inch flattened expanded pattern. Typical mesh openings 34 have a length of 0.133 inches and a width of 0.056 inches. However, other dimensions may also be utilized. The strand width of the mesh in a typical application is 0.040 inches, and the thickness may be 0.043 inches. It has been found that the diamond pattern utilized provides sufficient flexure to accommodate the mounting hardware, while providing sufficient rigidity to adequately engage and retain the hardware. In addition, the diamond pattern mesh forms an extended web to spread the load placed on the mesh outward over the entire area of the mesh elements 22, 24 and 26.

The pointed tab portions 30 may simply be corners of the planar portion 32 bent at a substantially transverse angle to the planar portion 32. A typical tab portion 30 extends to a depth of ¼ inch so that it grips the substrate 102. However, other configurations are possible that provide engagement and retention to the substrate 102.

As shown in FIGS. 1–11, the backing elements 22, 24 and 26 may be used to mount a variety of fixtures 42. However, the mounting system may also be utilized for direct support of the corner wall covering layer 104. For example, abutting drywall panels may have a seam that is not aligned with a stud. To provide improved support, the backing elements 22 may be attached to the substrate 104 such that the backing elements 22 span the seam between the drywall panels 104. It can be appreciated that this mounting system 20 provides for improved mounting that is hidden when the wall covering 104 is finished.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A mounting system, comprising:

a substrate;

an interlocking planar mesh backing element having interconnected strands defining a multiplicity of openings, including pointed mesh tab portions extending substantially transversely to the plane of the mesh element;

a covering layer overlaying the substrate and the mesh backing element;

an attachment member having fasteners extending through the covering layer and the mesh backing element and engaging the substrate to attach the attachment member onto the covering layer over the substrate.

2. A mounting system according to claim 1, wherein the backing element has a thickness of approximately one-eighth inch.

3. A mounting system according to claim 1, wherein the tab portions extend approximately one quarter inch from the plane of the backing element.

4. A mounting system according to claim 1, wherein the interlocking planar mesh backing element defines each of the openings having a length at least twice its width.

5. A mounting system according to claim 1, wherein the strands have a width and thickness of approximately 0.04 inches.

6. A mounting system according to claim 1, wherein the interlocking planar mesh backing element strands define a substantially diamond shaped pattern.

7. A mounting system according to claim 1, wherein the pointed mesh tab portions are located at corners of the backing element.

8. A wall mounting system, comprising:

a substrate;

an interlocking mesh backing element comprising a network of interconnected strands and pointed mesh tab portions extending outward from the mesh backing element;

a wall covering layer overlaying the substrate and the mesh backing element;

a fixture having attachment members extending through the wall covering layer and the mesh backing element into the substrate.

9. A mounting system according to claim 8, wherein the wall covering layer comprises drywall.

10. A mounting system according to claim 8, wherein the mesh backing element defines a multiplicity of openings.

11. A mounting system according to claim 8, wherein the mesh defines a substantially diamond shaped pattern.

12. A mounting system according to claim 8, wherein the pointed mesh tab portions are located at corners of the backing element.

13. A method of mounting a fixture to a wall, including one or more interlocking mesh backing elements with mesh tab portions extending from a planar section of the mesh backing element, attachment members configured for retaining the fixture, the method comprising the steps of:

pressing the tab portions of the mesh backing element into the wall such that the mesh backing element is retained against the wall;

covering the mesh backing element with a wall covering layer;

driving one or more attachment members through the fixture the wall covering layer and through the mesh backing element into the wall.

14. A method according to claim 13, wherein the tab portions are pointed.

15. A method according to claim 14, wherein the tab portions are located at corners of the backing element.

16. A method according to claim 14, wherein the interlocking mesh backing element defines a substantially diamond shaped pattern.

* * * * *